US010063962B2

(12) United States Patent
Bruss

(10) Patent No.: US 10,063,962 B2
(45) Date of Patent: Aug. 28, 2018

(54) VENTED ACOUSTIC ENCLOSURES AND RELATED SYSTEMS

(71) Applicant: Apple Inc., Cupertino, CA (US)

(72) Inventor: John Bruss, Santa Monica, CA (US)

(73) Assignee: Apple Inc., Cupertino, CA (US)

( * ) Notice: Subject to any disclaimer, the term of this patent is extended or adjusted under 35 U.S.C. 154(b) by 5 days.

(21) Appl. No.: 15/197,240

(22) Filed: Jun. 29, 2016

(65) Prior Publication Data

US 2017/0006373 A1 Jan. 5, 2017

Related U.S. Application Data

(60) Provisional application No. 62/187,107, filed on Jun. 30, 2015.

(51) Int. Cl.
*H04R 1/28* (2006.01)
*H04R 1/10* (2006.01)

(52) U.S. Cl.
CPC ..... *H04R 1/2826* (2013.01); *H04R 1/1075* (2013.01); *H04R 1/2849* (2013.01); *H04R 1/2888* (2013.01); *H04R 1/2857* (2013.01); *H04R 1/2865* (2013.01); *H04R 2201/029* (2013.01); *H04R 2400/11* (2013.01)

(58) Field of Classification Search
CPC .... H04R 1/021; H04R 1/1075; H04R 1/2823; H04R 1/2826; H04R 1/2846; H04R 1/2849; H04R 1/2853; H04R 1/2857; H04R 1/2888; H04R 2201/029; H04R 2460/11
See application file for complete search history.

(56) References Cited

U.S. PATENT DOCUMENTS 5,117,461 A 5/1992 Moseley
5,189,706 A * 2/1993 Saeki ..... H04R 1/2826 181/155
5,497,427 A * 3/1996 Nageno ..... H04R 1/1066 381/381
5,513,270 A * 4/1996 Lewis ..... H04R 1/2826 181/160

(Continued)

OTHER PUBLICATIONS

Kolbrek, Bjorn. "Horn Theory: An Introduction". Part 1 and 2. AudioXPRESS. 2008.

*Primary Examiner* — Joshua Kaufman
(74) *Attorney, Agent, or Firm* — Ganz Pollard, LLC

(57) ABSTRACT

An enclosure for a speaker transducer can have a front housing member and a rear housing member. Some enclosures position the speaker transducer between the front housing member and the rear housing member, and spaced apart from the rear housing member to define a rear chamber positioned between the speaker transducer and the rear housing member. The rear housing member can define a longitudinal axis. A first waveguide member and a second waveguide member can be longitudinally spaced apart from each other to define an acoustic waveguide therebetween oriented transversely relative to the longitudinal axis. A port can acoustically couple the acoustic waveguide with the rear chamber. A cross-sectional area of the waveguide can expand radially outward of the port. And, the acoustic waveguide can extend circumferentially around the longitudinal axis more than 90-degrees. Some embodiments include a speaker transducer and are suitable as a headphone.

22 Claims, 10 Drawing Sheets

(56) References Cited

U.S. PATENT DOCUMENTS

| | | | | |
|---|---|---|---|---|
| 5,778,081 | A | 7/1998 | Patrick | |
| 5,804,774 | A * | 9/1998 | Ford | G10K 9/04 181/152 |
| 6,473,625 | B1 | 10/2002 | Williams et al. | |
| 7,436,972 | B2 | 10/2008 | Bouvier | |
| 7,499,562 | B2 | 3/2009 | Shim | |
| 7,916,888 | B2 | 3/2011 | Sapiejewski et al. | |
| 8,300,871 | B2 | 10/2012 | Welsh et al. | |
| 8,406,444 | B2 | 3/2013 | Wang | |
| 8,774,444 | B2 | 7/2014 | Tiscareno et al. | |
| 8,976,994 | B2 | 3/2015 | Howes et al. | |
| 2013/0142375 | A1* | 6/2013 | Sung | H04R 1/1075 381/373 |
| 2014/0093113 | A1* | 4/2014 | Dix | H04R 1/2826 381/346 |

* cited by examiner

VENTED ACOUSTIC ENCLOSURES AND RELATED SYSTEMS

RELATED APPLICATIONS

This application claims the benefit of and priority to U.S. Patent Application No. 62/187,107, filed Jun. 30, 2015, the contents of which patent application are hereby incorporated by reference as if recited in full herein for all purposes.

BACKGROUND

This application, and the innovations and related subject matter disclosed herein, (collectively referred to as the "disclosure") generally concern acoustic enclosures, and more particularly but not exclusively, enclosures suitable for headphones, with several vented enclosures for headphones being but particular examples incorporating disclosed innovations. Some disclosed enclosures define a waveguide for enhancing a frequency response, while also being configured to provide a thin enclosure. Some disclosed waveguides are further configured to passively attenuate environmental noise without substantially interfering with passive noise attenuation for headphones.

Audio headphones are worn on or over a user's ears. Audio headsets can have a headband for supporting a headphone in relation to a user's head. Often, such headsets include a pair of headphones, and the headband supports and separates the headphones from each other. Each headphone, in turn, can have one or more respective speaker transducers, sometimes referred to as "speakers" or "loudspeakers positioned within a housing. Generally speaking, the housing can define an acoustic enclosure for the speaker, providing the headphone with selected acoustic characteristics (e.g., a selected response at various audible frequencies, a degree of acceptable harmonic distortion, etc.). Headphones can also have ear pads, or cushions. Typically, ear cushions are provided to make wearing the headset comfortable, and to passively attenuate ambient noise.

As noted, ear pads for headphones or ear cushions for earphones can improve comfort for a user. Circumaural headphone ear pads and occluding earphone ear cushions, and to a smaller extent supraaural headphone ear pads and non-occluding earphone ear cushions, can also attenuate sound waves emitted by sources other than a corresponding headphone or earphone speaker transducer and can thus improve a user's listening experience in relation to sound emitted by the transducer. Such attenuation is sometimes referred to in the art as "passive" noise cancellation or attenuation.

In general, "passive" noise attenuation mechanically insulates a wearer's ear in relation to environmental sources of sound (generally referred to as "noise"). Although passive noise attenuation can improve a user's listening experience, it can be ineffective or less effective than desired for some frequency bands (e.g., below about 500 Hz).

A circumaural headphone, commonly referred to in the art as an "over-the-ear headphone," has an ear pad configured to surround a user's outer ear and presses directly against the user's head at a position outwardly of the ear. By contrast, a supraaural headphone, commonly referred to in the art as an "on-ear headphone", has an ear pad that rests on the wearer's outer ear.

Circumaural and supraaural headphones are contrasted with earphones that have small speaker enclosures typically worn in the user's outer ear, e.g., at an entrance to the wearer's ear canal. Some earphones do not have ear cushions. Other earphones have a cushioning member configured to enhance user comfort and/or to modify sound quality. Some cushioning members for earphones occlude a wearer's ear canal, and other cushioning members do not occlude the ear canal.

An enclosure for a speaker can define a first chamber and an opposed second chamber positioned opposite the first chamber relative to the speaker. Each chamber can be sealed or vented. Although a sealed chamber is not necessarily hermetically sealed, a sealed chamber inhibits or substantially prevents a flow of an ambient fluid, for example, air, across a boundary of the chamber as a diaphragm of the speaker vibrates to-and-fro emitting sound. By contrast, a vented chamber permits a flow of the ambient fluid across a boundary of the chamber. A given speaker combined with a vented chamber can provide different acoustic characteristics as compared to the same speaker combined with a sealed chamber.

For example, overall sound quality of a speaker combined with a sealed chamber, particularly in context of an enclosure for an earphone or headphone, is sometimes described as providing improved bass response, yet with a smaller soundstage and less fidelity compared to a vented (or "open") enclosure. Such fidelity loss can arise, in part, from sympathetic acoustic and mechanical resonances within the chamber.

Nonetheless, conventional open enclosures do not lend themselves to passive acoustic attenuation, as external noise can "leak" through conventional vented chambers. As well, audio playback can "leak" through conventional open enclosures and disturb others near the listener.

An acoustic transmission line, or waveguide, can improve low-end frequency response of a vented enclosure. However, acoustic waveguides desirably provide a continuously expanding cross-sectional area (or nozzle). Conventional waveguides, therefore, have been large and bulky, and generally unsuitable for use in applications where small or otherwise diminutive enclosures are required or desired, such as in headphone or earphone applications, or in applications where aesthetic considerations are important.

Therefore, a need exists for improved loudspeaker enclosures. For example, enclosures providing strong bass response combined with high fidelity over desired audible frequencies are needed. A similar need exists for small or diminutive enclosures that allow users to enjoy accurate (e.g. low-distortion) reproduction of sound over extended low-frequencies. As well, a need remains for such enclosures that provide substantial passive noise attenuation. In addition, a need remains for such enclosures that are compatible with thin headphones and/or earphones.

SUMMARY

The innovations disclosed herein overcome many problems in the prior art and address one or more of the aforementioned or other needs. In some respects, innovations disclosed herein are directed to acoustic enclosures, and more particularly, but not exclusively, to headphone enclosure arrangements. In other respects, innovations disclosed herein pertain to vented speaker enclosures, with vented enclosures for headphones being but particular examples of acoustic enclosures incorporating innovative principles disclosed herein.

Enclosures for a speaker transducer are disclosed. A rear housing member can define a concave chamber region having a longitudinal axis extending therethrough. The enclosure can have a front wall and a rear wall longitudinally spaced apart from the front wall. A channel can be defined by the gap between the front wall and the rear wall. At least a segment of the channel can be oriented transversely relative to the longitudinal axis. A port can extend between the chamber region and the channel. The channel extends at least 90-degrees circumferentially around the longitudinal axis, and wherein a cross-sectional area of the channel continuously expands radially outward of the port.

Headphones are also disclosed. A headphone can have a speaker transducer, a front housing member and a rear housing member. The speaker transducer can be positioned between the front housing member and the rear housing member, and spaced apart from the rear housing member to define a rear chamber positioned between the speaker transducer and the rear housing member. The rear housing member can define a longitudinal axis. A first waveguide member and a second waveguide member can be spaced apart from each other to define an acoustic waveguide oriented transversely relative to the longitudinal axis. The waveguide can be acoustically coupled with the rear chamber through a port. A cross-sectional area of the acoustic waveguide can expand radially outward of the port relative to the longitudinal axis. The acoustic waveguide can also extend circumferentially more than 90-degrees around the longitudinal axis.

The foregoing and other features and advantages will become more apparent from the following detailed description, which proceeds with reference to the accompanying drawings.

BRIEF DESCRIPTION OF THE DRAWINGS

Unless specified otherwise, the accompanying drawings illustrate aspects of the innovative subject matter described herein. Referring to the drawings, wherein like numerals refer to like parts throughout the several views and this specification, several embodiments of presently disclosed principles are illustrated by way of example, and not by way of limitation, wherein.

DETAILED DESCRIPTION

The following describes various innovative principles related to acoustic enclosures by way of reference to specific examples of headphone enclosures, and more particularly but not exclusively, to vented headphone enclosures. Nonetheless, one or more of the disclosed principles can be incorporated in various other enclosures, or systems, to achieve any of a variety of corresponding system characteristics. Acoustic enclosures and systems described in relation to particular configurations, applications, or uses, are merely examples of acoustic enclosures and systems incorporating one or more of the innovative principles disclosed herein and are used to illustrate one or more aspects of the innovative principles.

Thus, enclosures and systems having attributes that are different from those specific examples discussed herein can embody one or more of the innovative principles, and can be used in applications not described herein in detail, for example, acoustic enclosures for earphones, home-stereo speakers, speaker bars, hearing aids, automobile speakers, etc. Accordingly, alternative embodiments of disclosed innovations also fall within the scope of this disclosure.

Overview

Figure 1A:
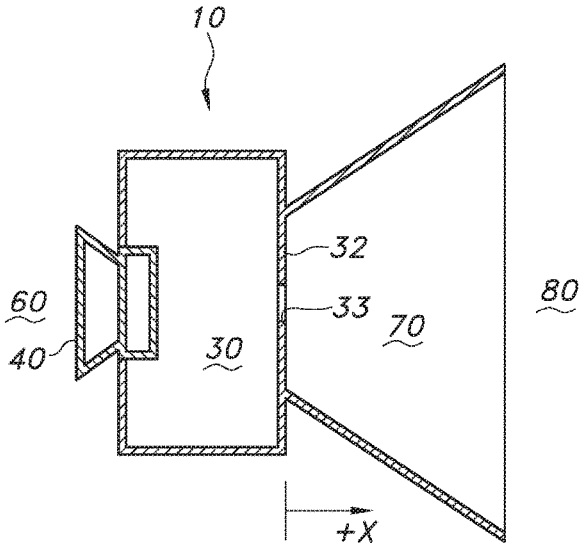
FIG. 1A shows a side view of a loudspeaker enclosure having a longitudinally extending waveguide.

FIG. 1A schematically illustrates a portion of an enclosure 10 for a speaker transducer. The enclosure defines a rear chamber 30 positioned "behind" a transducer 40 (i.e., relative to a front environment 60 adjacent a diaphragm of the transducer). A rear wall 32 of the chamber 30 defines an acoustic port 33 opening to a waveguide 70 extending longitudinally away from the rear chamber. The waveguide 70 opens to a rear environment 80.

Figure 1B:
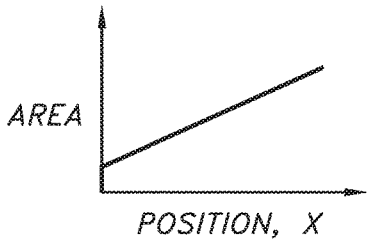
FIG. 1B shows a plot of cross-sectional area in relation to longitudinal position for the waveguide shown in FIG. 1A.

A cross-sectional area of the illustrated waveguide 70 changes in proportion to a longitudinal distance, X, away from the wall 32 separating the rear chamber 30 from the waveguide. The acoustic port acoustically couples the rear chamber 30 to the acoustic waveguide 70, or horn, and can provide improved fidelity (e.g., in part through reducing resonance) compared to similarly sized enclosures having a sealed rear chamber. To achieve such improved fidelity, the cross-sectional area of the waveguide 70 continually and monotonically expands in correspondence with the longitudinal distance, X, from the acoustic port 33 in the rear wall 32, as indicated in the plot in FIG. 1B. The enclosure 10, chamber 30, and waveguide 70 can be axisymmetric (e.g., about a longitudinally extending axis parallel to the X-axis shown in FIG. 1B), but need not be.

The waveguide acts like a tuning tube when the mesh does not occur until after the waveguide. The rear chamber 30 can be "tuned" by adjusting a cross-sectional area of the port 32. An acoustic damper, or mesh, can adjust the Q factor of that tuning by damping the air flow through the port.

The Q factor is a dimensionless parameter that compares the exponential time constant $\tau$ for decay of an oscillating physical system's amplitude to its oscillation period. It compares a frequency at which a given system oscillates to a rate at which it dissipates its energy. Physically speaking, Q is $2\pi$ times a ratio of the total energy stored divided by the energy lost in a single cycle or equivalently a ratio of the stored energy to the energy dissipated over one radian of oscillation.

A theoretically perfect transmission line, or waveguide, would absorb all frequencies entering the line from the rear chamber, but is not practically attainable, as it would have to be infinitely long. In physically implementable waveguides, usually upper bass frequencies are loaded (e.g., fully absorbed), and the low-end bass frequencies are allowed to freely radiate from enclosure. Waveguides thus effectively function like a low pass filter, providing a sort of physically implemented acoustic crossover. This energy combines with the output of the bass unit, extending the enclosure's low-frequency response.

Once the enclosure is tuned, the waveguides guide the output to the outside environment. Critically damping the port with an acoustic mesh can provide a smooth frequency response to the enclosure.

Figure 1C:
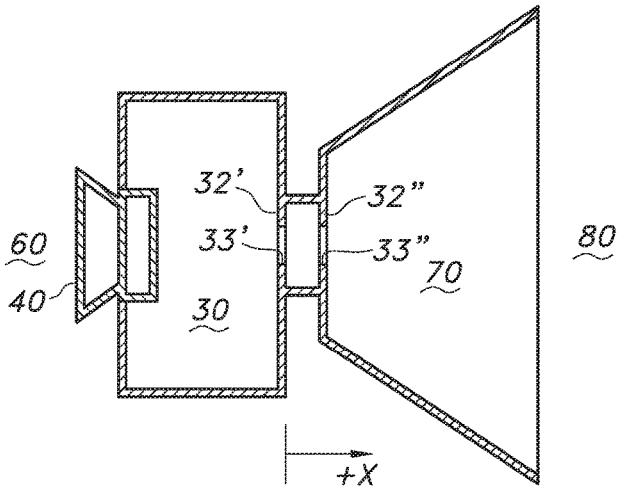
FIG. 1C shows a side view of another loudspeaker enclosure having a longitudinally extending waveguide.

Structure shown in FIG. 1C is similar, but not identical, to structure shown in FIG. 1A. Such similar structure shares the same reference numeral as that shown in FIG. 1A, but the difference is indicated by a prime (i.e., a "'") or a double prime (i.e., a """). The rear wall 32' in FIG. 1C defines a first acoustic port 33'. Longitudinally aft of the first acoustic port, the enclosure defines a throat having an expanded cross-sectional area, and a second rear wall 32" defines a second acoustic port 33". The nozzle portion of the waveguide 70 expands longitudinally aft of the second port 33" in an identical fashion as the waveguide 70 shown in FIG. 1A.

Figure 1D:
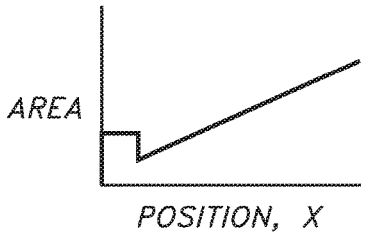
FIG. 1D shows a plot of cross-sectional area in relation to longitudinal position for the waveguide shown in FIG. 1C.

However, the enclosure shown in FIG. 1C yields inferior fidelity compared to the enclosure shown in FIG. 1A because the enclosure in FIG. 1C does not provide a monotonically increasing cross-sectional area for sound waves to expand. As FIG. 1D shows, the cross-sectional area expands longitudinally immediately aft of the first acoustic port 32', remains constant over the length of the throat, contracts at the second acoustic port 33" and then expands monotonically aft of the second acoustic port. Such expansion followed by contraction can impair acoustic performance.

Each waveguide 70 defines a major axis corresponding to a general direction over which the cross-sectional area expands. In FIGS. 1A and 1C, the major axis defined by the waveguide 70 is coextensive with a longitudinal axis defined by the rear chamber 30. Consequently, the waveguide 70 shown in FIGS. 1A and 1C extends longitudinally away from the rear chamber 30 and the transducer 40, yielding a longitudinally deep enclosure 10 generally ill-suited for applications requiring a shallow enclosure.

Enclosures Having a Radial Waveguide

In contrast to the enclosures shown in FIGS. 1A and 1C, FIGS. 2 through 10 illustrate relatively shallow enclosures 110, 210 having waveguides extending generally radially outward and circumferentially of a longitudinal axis defined by each respective enclosure. For example, the waveguides 170, 270 shown in FIGS. 2 and 4 include a segment having a major axis oriented transversely, and in some instances orthogonally, relative to the longitudinal axis 102 of the enclosure. Despite having a constant or nearly constant channel height (e.g., spacing between walls), the acoustic cross-sectional area of the waveguides 170, 270 expands in correspondence with increasing radial dimension relative to the longitudinal axis 102. Such a "flat," radial expansion keeps the waveguide and enclosure longitudinally thin while obtaining acoustic benefit of a continuously expanding cross-sectional area, as with the waveguide 70 shown in FIG. 1A.

Despite being substantially "thinner", the enclosures 110, 210 still provide desirable acoustic performance. In some instances, the rear chamber 230, 330 can have a volume of about 15 $cm^3$ (cubic centimeters, or "cc"). Chambers having different volumes are contemplated. In some instances, a rear chamber 130, 230 can have a volume between about 10 cc and about 20 cc, such as between about 14 cc and about 18 cc, with about 18.4 cc being but one particular example.

An acoustic port 124, 224 can have a cross-sectional area of about 150 $mm^2$ (square millimeters, or sq. mm.). Acoustic ports can have different areas, as well, such as between about 100 sq. mm and about 200 sq. mm., such as between about 130 sq. mm and about 170 sq. mm, with about 150 sq. mm. being but one particular example.

Figure 2:
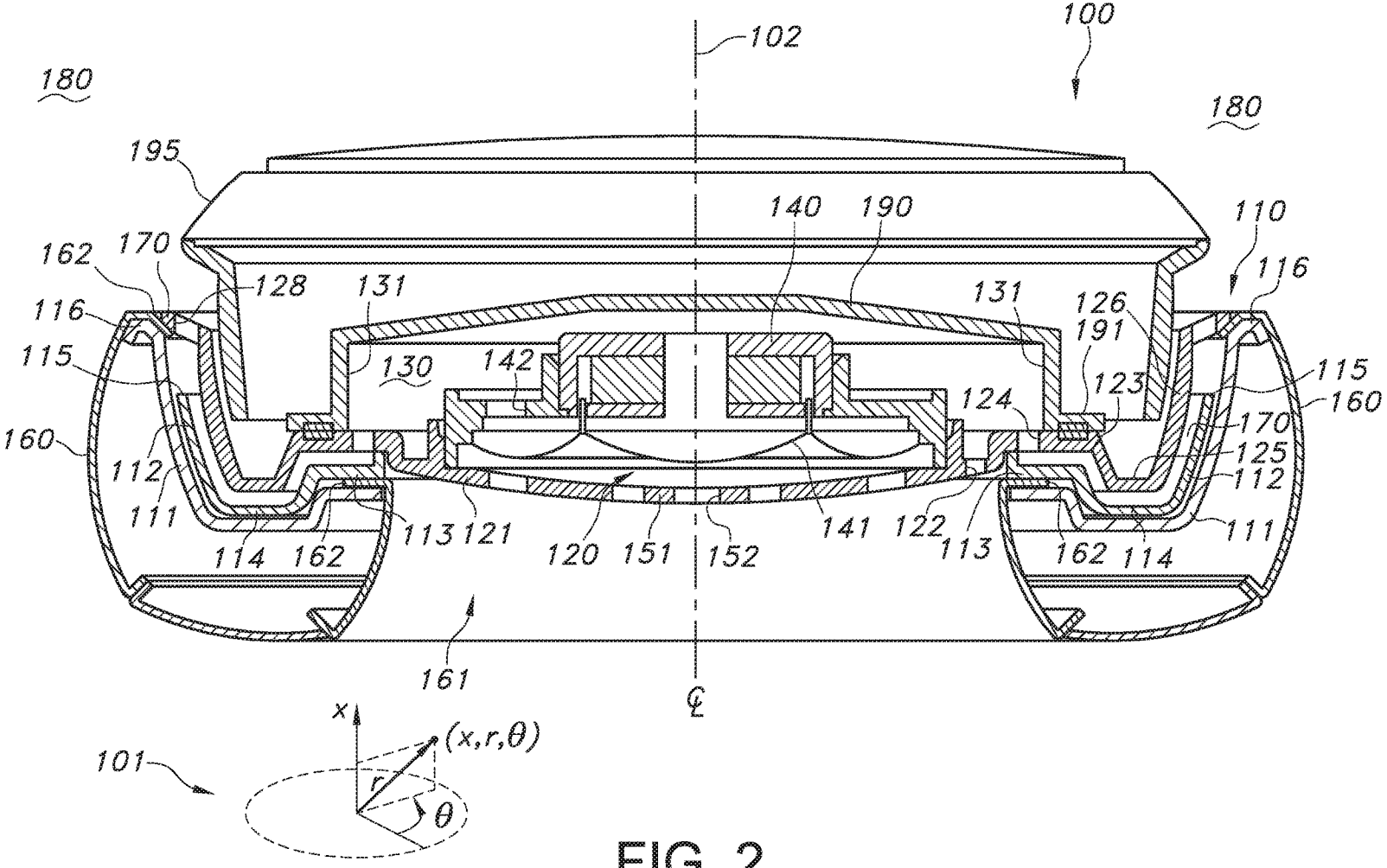
FIG. 2 schematically illustrates a side view of a cross-section of a headphone enclosure having a radially extending waveguide.

FIG. 2 shows a first embodiment of a enclosure 110 for a speaker transducer 140, and FIGS. 3 through 10 show a second embodiment of a loudspeaker enclosure 210 for a speaker transducer 240. Both enclosures 110, 210 are suitable for headphone applications. The enclosures 110, 210 share several common features, including radially extending waveguides 170, 270. For succinctness, several other common aspects of the enclosures 110, 210 are described in this section. Additional aspects of each enclosure are described separately, below.

The enclosures 110, 210 can be described using a cylindrical coordinate system 101 (FIG. 2). In each enclosure, a longitudinal axis 102 extends generally centrally through a center of the enclosure 110, 210. A radial dimension, r, extends orthogonally from the longitudinal axis, and an azimuthal dimension, θ, extends circumferentially around the longitudinal axis 102. Although a cylindrical coordinate system is convenient for describing the generally cylindrical headphone embodiment depicted in FIGS. 2 through 10, other headphone configurations are possible (e.g., a headphone having an elliptical cross-section taken orthogonally to the longitudinal axis 102). Thus, although enclosures having a circular cross-section (sectioned orthogonally relative to the longitudinal axis 102) are described in detail below, the principles described below are equally suited for non-circular cross-sections. Accordingly, each reference to a shape using a term connoting a circle can be substituted with reference to another shape corresponding to a given headphone's actual cross-sectional shape without departing from the principles disclosed herein (e.g., thin waveguides that expand outwardly).

Each enclosure 110, 210 has a rear housing member 190, 210*a* defining a concave chamber region 130, 230 having a longitudinal axis 102 extending therethrough. Each enclosure 110, 210 also has a front wall 112, 212 and a rear wall 123, 223 longitudinally spaced apart from each other to define an outwardly expanding (relative to the longitudinal axis 102) channel 170, 270 positioned therebetween. As indicated in the cross-sectional views of FIGS. 2 and 4, a major axis defined by at least a segment of the channel 170, 270 formed between the front wall and the rear wall is oriented transversely relative to the longitudinal axis 102.

In both enclosures, 110, 210, a corresponding port 124, 224 extends between the chamber region 130, 230 and the channel 170, 270 forming the outwardly expanding (or radially extending) waveguide. In addition to extending radially, each channel 170, 270 extends circumferentially around the longitudinal axis by at least 90-degrees. For example, a projection of the illustrated waveguides 170, 270 on an r-O plane (shown in the cylindrical coordinate system 101 in FIG. 2) can define an annulus, or at least a sector thereof extending at least 90 degrees circumferentially around the axis 102. Waveguides of the type disclosed herein extend between at least 90 degrees and 360 degrees, such as between about 90 degrees and about 180 degrees, with particular waveguides extending circumferentially by between about 100 degrees and about 140 degrees, with about 120 degrees being but one particular example.

In each case, a cross-sectional area of the channel 170, 270 continuously expands in correspondence with increasing radial distance outward of the port 124, 224. For example, where the channel 170, 270 has a constant a gap-distance between the front wall 112, 212 and the rear wall 123, 223 at positions radially outward of the port 124, 224, the cross-sectional area of the channel outward of the port generally varies linearly with radial position relative to the longitudinal axis 102.

More particularly, the cross-sectional area at a given radial position, r, can be computed according to a product between the radial position, r, and an average longitudinal gap dimension between the front wall 112, 212 and the rear wall 123, 223 at the selected radial position. Accordingly, the radially extending waveguide 170, 270 can provide a suitable expansion of cross-sectional area to permit enhanced response at selected frequencies while maintaining a relatively thin (e.g., along the longitudinal direction 102) waveguide, and hence a relatively thin headphone 100.

However, cross-sectional area variation can deviate from a linear variation. For example, some enclosures have one or more standoffs, or support pillars, (not shown) extending between the front wall 112, 212 and the rear wall 123, 223 to inhibit vibration-induced contact between the front wall and the rear wall. Such standoffs can reduce the acoustic cross-sectional area by a nominal measure at a given radial distance from the axis 102. Effects arising from such area reductions can be mitigated, as by adjusting the pillars' location and/or by increasing a longitudinal gap between the front wall and the rear wall in regions adjacent the pillars.

The channel 170, 270 extends from a proximal (e.g., a radially inner) end positioned adjacent the acoustic port 124, 224 to a terminal (e.g., a radially outer) end positioned adjacent a vent 128, 228 between the channel 170, 270 and an environment 180, 280. Thus, the cross-sectional area of the channel can continuously expand from a position radially outward of the port to a position adjacent the vent.

As with the port 33 shown in FIG. 1A, a cross-sectional area of the port 124, 224 is substantially less than a cross-sectional area of the chamber region 130, 230 adjacent the port and substantially less than the cross-sectional area of the channel 170, 270 at a position adjacent the port. Stated differently, the acoustic port 124, 224 represents a sudden contraction and a sudden expansion from the rear chamber region.

The gap spacing and rate of outward expansion of the waveguide, as well as the degree of damping of apertures 152, 124 in the grille region 151 and adjacent the waveguide 170, respectively, can be selected in accordance with their respective effects on overall headphone tuning. For example, the gap spacing between the front waveguide member 112, 212 and the rear waveguide member 123, 223 can vary radially in a selected manner to achieve a desired waveguide tuning.

As well, an acoustic damper, e.g., an acoustic mesh, can overlie the port 124, 224 to tune a frequency response of the enclosure 110, 210. In some working embodiments, the port and the channel can operate as an acoustic low-pass filter having a cut-off frequency less than about 1,500 Hz, such as, for example, between about 1,250 Hz and about 1450 Hz.

Figure 4:
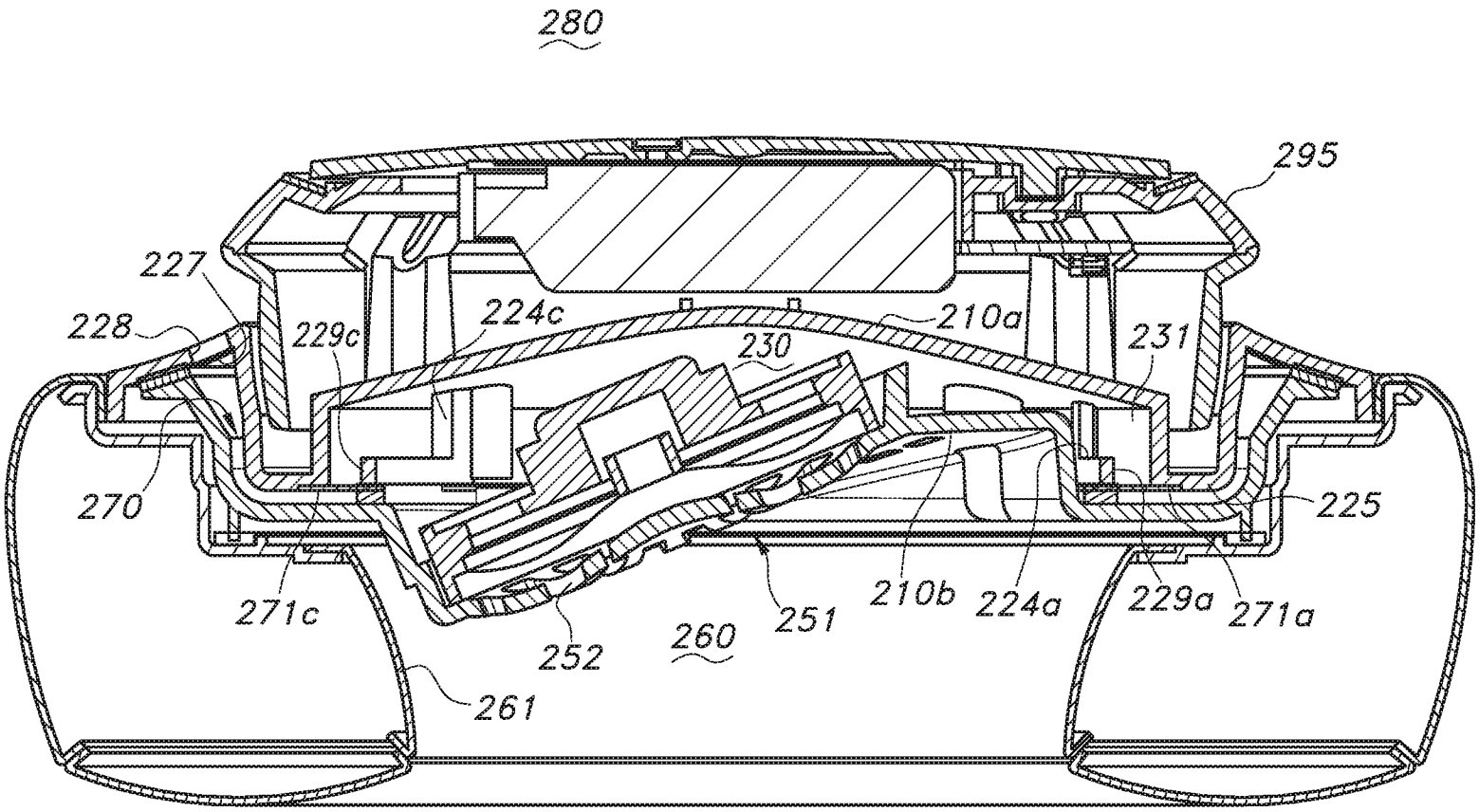
FIG. 4 shows a side view of a cross-section of the headphone enclosure shown in FIG. 3.
Figure 5:
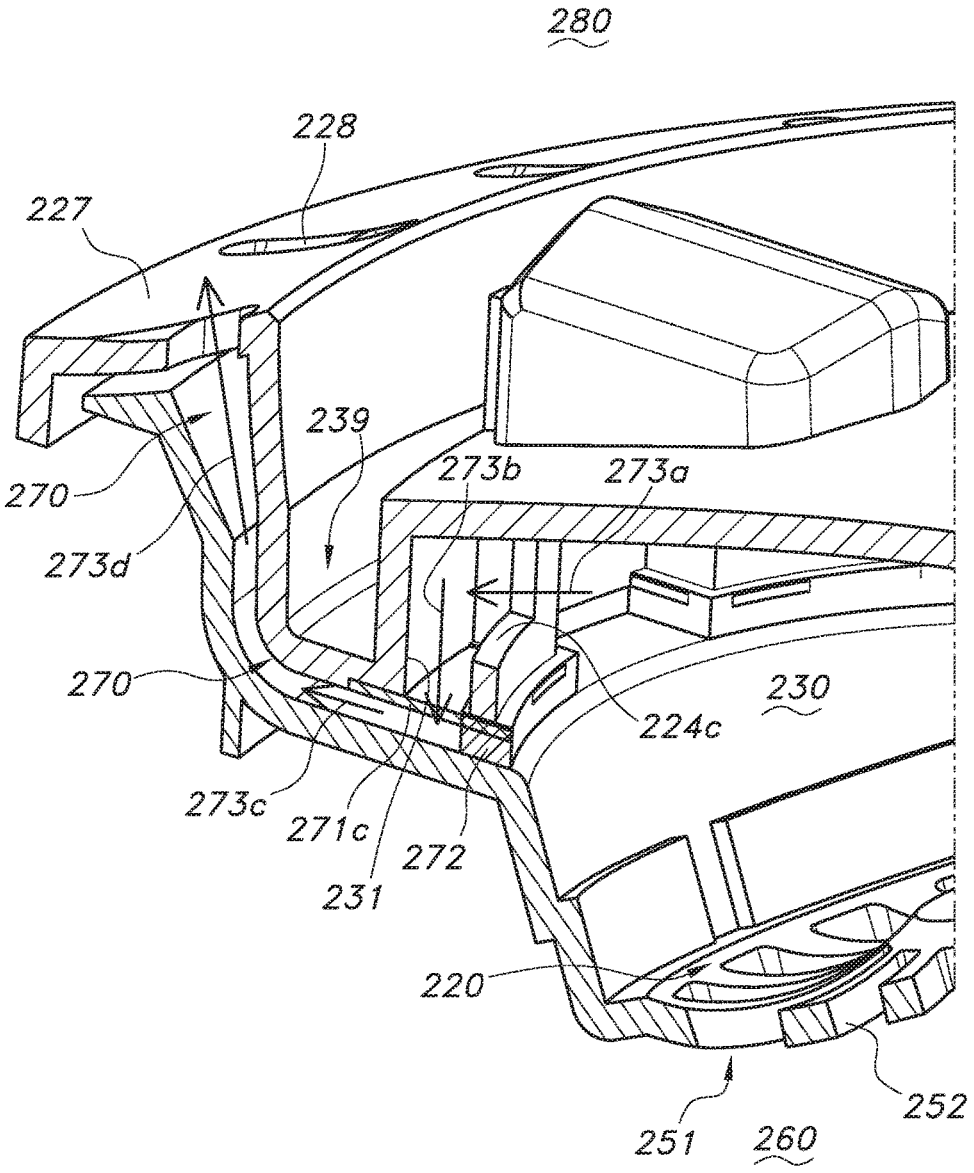
FIG. 5 shows additional detail of the cross-section shown in FIG. 4.

And, a direction of the major axis of the channel 170, 270 can vary from being directly outward (e.g., orthogonal to the axis 102) to being within several (e.g., about 10) degrees of parallel to the axis 102, as the arrow 273*d* in FIG. 5 indicates. Thus, as the channel 170, 270 extends radially outward of the port 124, 224, the major axis of the channel can follow a circuitous outward path, as indicated by the arrows 273*a, b, c* and *d*. Configurations of the front walls 112, 212 and the rear walls 123, 223 providing specific examples of such circuitous paths are described more fully below in connection with the specific enclosure embodiments shown in FIG. 2 and in FIGS. 3-10. Headphones having a circuitous waveguide 170, 270 can attenuate acoustic noise entering the terminal end of the channel from the environment, e.g., through the vent 128, 228, enhancing passive attenuation of ambient noise while providing extended low-frequency response.

A generally annular cushion member 160, 260 extends longitudinally inward of the housing, defining an open interior region 161, 261 configured to receive a wearer's outer ear when the headphone 100 is donned. The cushion member 160, 260 can be formed of any suitable material arranged in any suitable configuration to provide a wearer comfort. Some arrangements permit the cushion to sealingly engage a wearer's head to provide a measure of passive noise attenuation.

An annular cushion retainer 111 (FIG. 2, similar structure is shown but unlabeled in FIG. 4) can matingly engage with a relatively distal waveguide member 112 to retain an inner most edge 162 of the cushion member 160 therebetween.

Enclosure Example 1

Additional details of the headphone 100 shown in FIG. 2 will now be described.

The enclosure 110 shown in FIG. 2 has a front housing member 121. The rear waveguide member 123 extends outwardly from the front housing member 121. Stated differently, the front housing member 121 and the rear waveguide member 123 shown in FIG. 2 constitute respective portions of a unitary construct. In FIG. 2, the front housing member 121 defines the acoustic port 124.

As shown in FIG. 2, an enclosure 110 for a headphone 100 can have a first chamber 120 and an opposed second chamber 130 relative to a speaker transducer 140. The first chamber 120 can be positioned between the transducer 140 and a grille portion 151 positioned adjacent an open region 161 occupied by a wearer's ear (not shown) when the headphone 100 is donned. The grille portion 151 can define a plurality of apertures 152, and a suitable acoustic mesh (not shown) can overlie the grille portion so as to provide a selected degree of acoustic damping across the grille.

The opposed second chamber 130 can be positioned on a side opposite the first chamber 120 relative to the transducer 140, such that the transducer 140 lies, at least generally, between the first chamber 120 and the second chamber 130. The first chamber 120 is sometimes referred to in the art as a "front chamber" and the second chamber 130 is sometimes referred to in the art as a "rear chamber." An annular boundary of the second chamber 130, in this instance a housing wall 131, can encircle the transducer 140 and lie adjacent to, and radially outward of, the first chamber 120. Such an arrangement of the chambers 120, 130 can provide suitable acoustic performance while maintaining an acceptably thin enclosure 110.

One or more walls 131, 190 can define corresponding boundaries of the rear chamber 130. A plurality of apertures, or ports, 124 can extend through a boundary of the rear chamber 130 to acoustically couple the rear chamber 130 with a channel 170 extending outwardly of the ports relative to the transducer 140. As FIG. 2 shows, the apertures can extend through a wall defining a boundary of the rear chamber 130. A suitable acoustic mesh can damp each port 124 to facilitate tuning of the enclosure 110.

As also shown in FIG. 2, disclosed waveguides (e.g., channel 170) can extend in a circuitous path, generally radially outward of the transducer 140. A circuitous waveguide 170 can provide a desired degree of passive attenuation of non-directional, external noise.

Front housing member 121 defines a generally circular grille region 151 corresponding to a generally circular headphone transducer 140. The grille region 151 is spaced apart from a diaphragm member 141 of the transducer 140 to define a front chamber 120 therebetween. The grille region 151 defines a plurality of apertures 152, and an acoustic mesh (not shown) can overlie the grille region to selectively damp (e.g., to tune) the front chamber 120. In some instances, the grille region 151 defines a domed region positioned proximally of the transducer and its diaphragm 141.

Radially outward of the grille region 151 and the transducer 140, the housing member 121 defines an aperture 122 extending between a rear chamber 130 and the open interior region 161 defined by the annular cushion member 160. The aperture 122 can have any suitable arrangement. For example, the aperture can comprise a plurality of circular openings, a plurality of arcuate slots, or a plurality of any other suitable opening. The aperture 122 opening between the rear chamber 130 and the open interior region 161 can be covered with an acoustic mesh for tuning the rear chamber. In some embodiments, a sufficient land area positioned outward of the aperture can provide a region of attachment (e.g., for adhesive attachment) for the mesh.

In FIG. 2, an innermost portion 113 of the annular waveguide member 112 extends radially outward substantially in an r-Θ plane to define a bearing surface for urging against a corresponding inner-most portion of the cushion member 160. Radially outward of the bearing surface, the illustrated waveguide member 112 defines a convex surface 114 (relative to a user's head, or a proximal position along the longitudinal axis 102). Stated differently, outwardly of the radially inner-most portion 113, the waveguide member 112 extends longitudinally proximally of the radially innermost portion 113 before gently and continuously curving outward and extending radially outward to a proximal-most longitudinal position. At the proximal-most longitudinal position, the convex surface 114 extends radially outward in an r-Θ plane and curves to extend distally relative to the longitudinal axis 102, while still flaring radially outward to an outermost edge 115.

A thin foam or other suitable vibration-damping material can be positioned between the convex surface 114 of the waveguide member 112 and a corresponding concave surface of the cushion retainer 111 to inhibit rattling between the closely spaced members 111, 112. The outermost edge 115 of the illustrated waveguide member 112 is positioned proximally along the longitudinal axis 102 relative to an outermost edge 116 of the cushion retainer 111.

In FIG. 2, the housing member 121 extends in a longitudinally distal direction outward of the axis 102 before curving to extend predominantly radially outward to define a generally annular rear waveguide member 123 having a complementary shape compared to the front waveguide member 112. In the predominantly radially outward portion of the housing member 121, an aperture 124 can open between the rear chamber 130 and an open waveguide region 170 defined by the gap between the longitudinally proximal (or front) waveguide member 112 and the longitudinally distal (or rear) waveguide member 123 of the housing member 121. The aperture 124 is configured as an acoustic port.

Like the front waveguide member 112 and the cushion retainer 111, the rear waveguide member 123 can define a convex region 125 positioned radially inward of an outermost, predominantly longitudinally extending wall portion 126. An outermost lip 127 of the housing member 121 can be positioned opposite a corresponding land region 116 of the cushion retainer 111 relative to an outermost edge 162 of the cushion member 160. The outermost edge 162 of the cushion member 160 can be retained between the outermost lip 127 of the housing member 121 and the land region 116 of the cushion retainer 111.

The front housing member 121 can define an aperture 128 positioned radially inward of the outermost lip 127. The aperture, or vent, 128 can open between a radially outermost portion of the waveguide 170 and an environment 180 external of the headphone 100.

The speaker transducer 140 can be positioned longitudinally distally of the front housing member 121 and cocentrically aligned with the circular grille portion 151 thereof. A generally dome-shaped rear housing member 190 can enclose a rear region 142 of the transducer 140 to define the rear chamber 130. As shown in FIG. 2, an annular flange 191 portion of the dome-shaped housing member 190 can urge against or matingly engage with a corresponding annular flange of the housing member 121, enclosing the rear chamber 130.

The headphone 100 can also include an outermost housing member 195 overlying the generally dome shaped member 190, defining a suitable enclosure for, for example, digital signal processing components, microphones, processors, and other headphone components.

Enclosure Example 2

Additional details of the headphone 100 shown in FIGS. 3 through 10 will now be described.

The enclosure 210 defines an outwardly expanding waveguide 270 using a different housing arrangement. Unlike the rear waveguide member 123 shown in FIG. 2 which extends outwardly from the front housing member 121, the rear waveguide member 223 in FIGS. 3-10 extends from the rear housing member 210*a*. Stated differently, the rear waveguide member 223 and the rear housing member 210 constitute a respective portions of a unitary construct.

Figure 3:
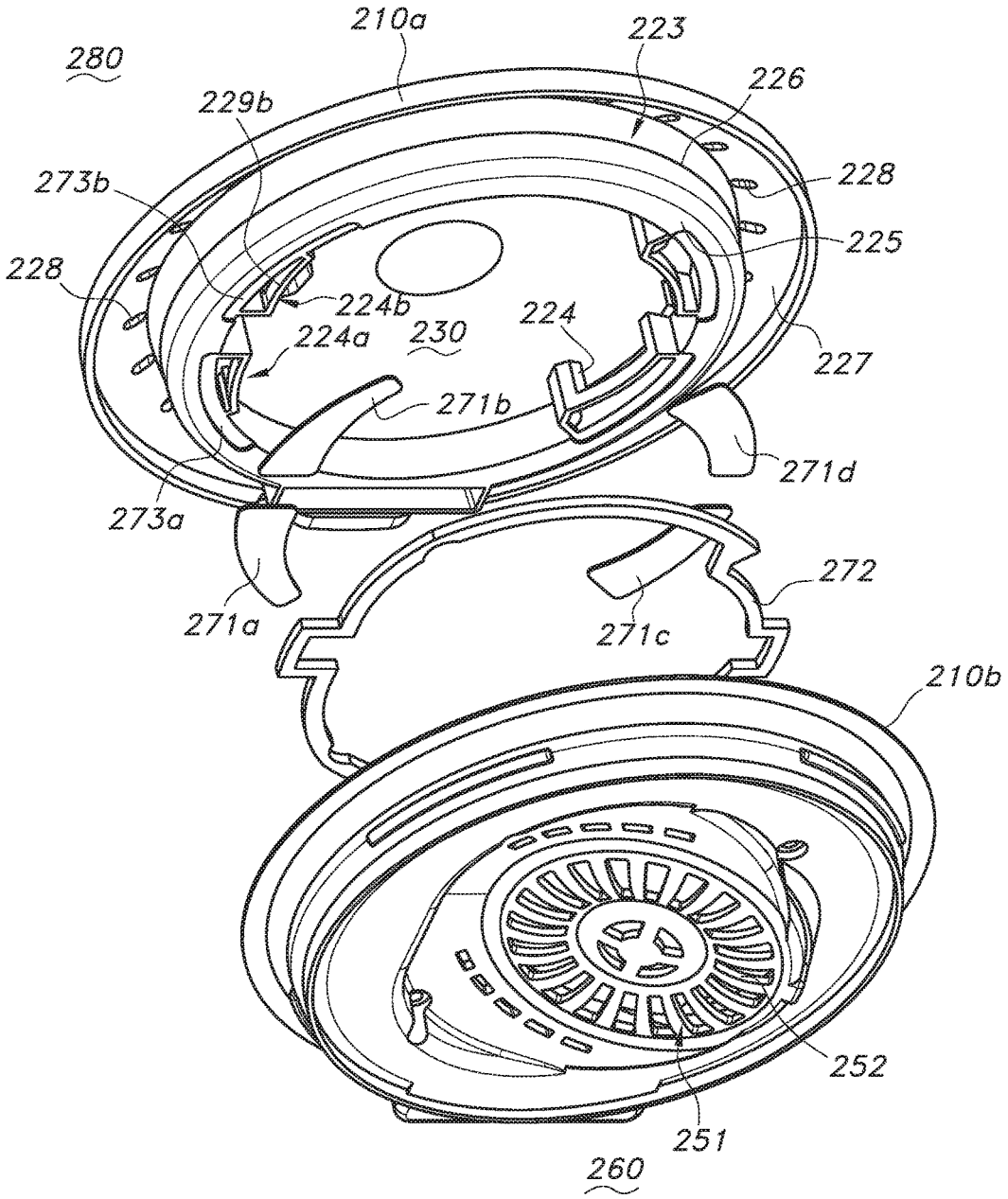
FIG. 3 shows an exploded view of another headphone enclosure having a radially extending waveguide.

In FIG. 3, the front housing 210*b* defines a tilted grille region 251. Stated differently, the front grille region 251 defines a central axis of symmetry generally being coextensive with an axis of symmetry defined by the speaker transducer, as indicated in FIG. 4. The overlapping axes of symmetry are tilted with regard to the axis 102 shown in FIG. 2 and defined by the circumferential housing wall 231 (FIG. 4). Notwithstanding the canted speaker transducer, the waveguide 270 extends radially outward of the axis 102, similarly to the waveguide 170 shown in FIG. 2. Desirably, the area of the exhaust is between about 3- and about 5-times as large as the inlet to the ports 224*a-d*, such as between about 3.5- and about 4.5-times as large, with about 4-times as large being one particular example.

As FIG. 4 indicates, other port embodiments can be defined by an aperture extending through a boundary surface other than a boundary wall. In the embodiment shown in FIGS. 4 and 5, the aperture, or port, is defined by the cross-member 229 spaced from the circumferential wall 231, and is covered by an acoustic mesh 271 to damp the ports.

Figure 6:
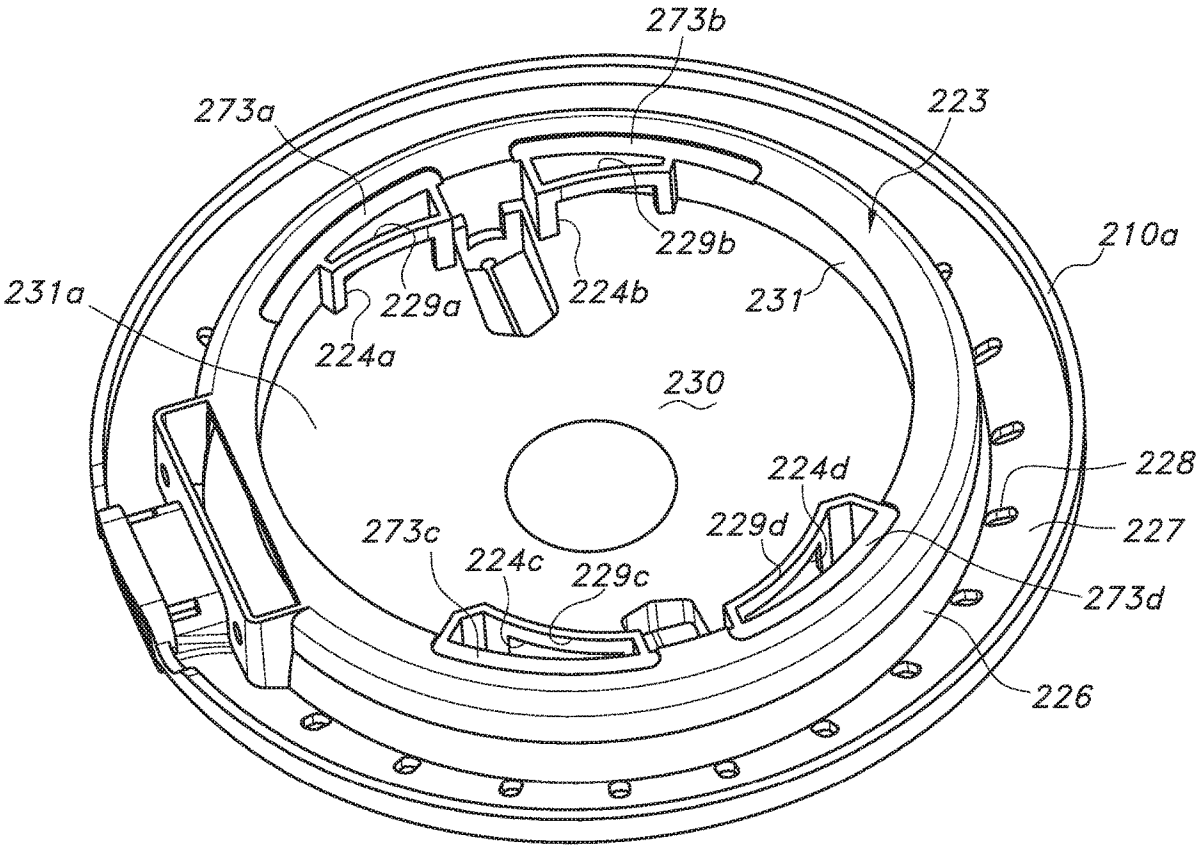
FIG. 6 shows the rear housing member shown in FIG. 4.

More specifically, the rear housing member 210*a* defines a spatially distributed acoustic port 224*a, b, c*, and *d*, as shown for example in FIGS. 3 and 6. An exemplary configuration of such a distributed acoustic port is described with particular reference to FIGS. 5 and 6. The housing 210*a* defines four ports 224*a-d*. Each port defines an entry aperture opening from the rear chamber 230, as indicated by the arrow 273*a*. The entry aperture is defined by a cross-bar 229*a-d* extending inwardly of the outer wall 231. An exhaust aperture opens from the port The rear wall 223 defines a radially extending surface 225. Recessed "below" (with reference to the inverted rear housing shown in FIG. 6) and substantially parallel to the surface 225, the port 224*a-d* defines an exhaust aperture between the cross-bar 229*a-d* and the circumferential outer wall 231. Also recessed from the surface 225 is a shoulder 273*a-d* extending around an outer periphery of each aperture.

Figure 7:
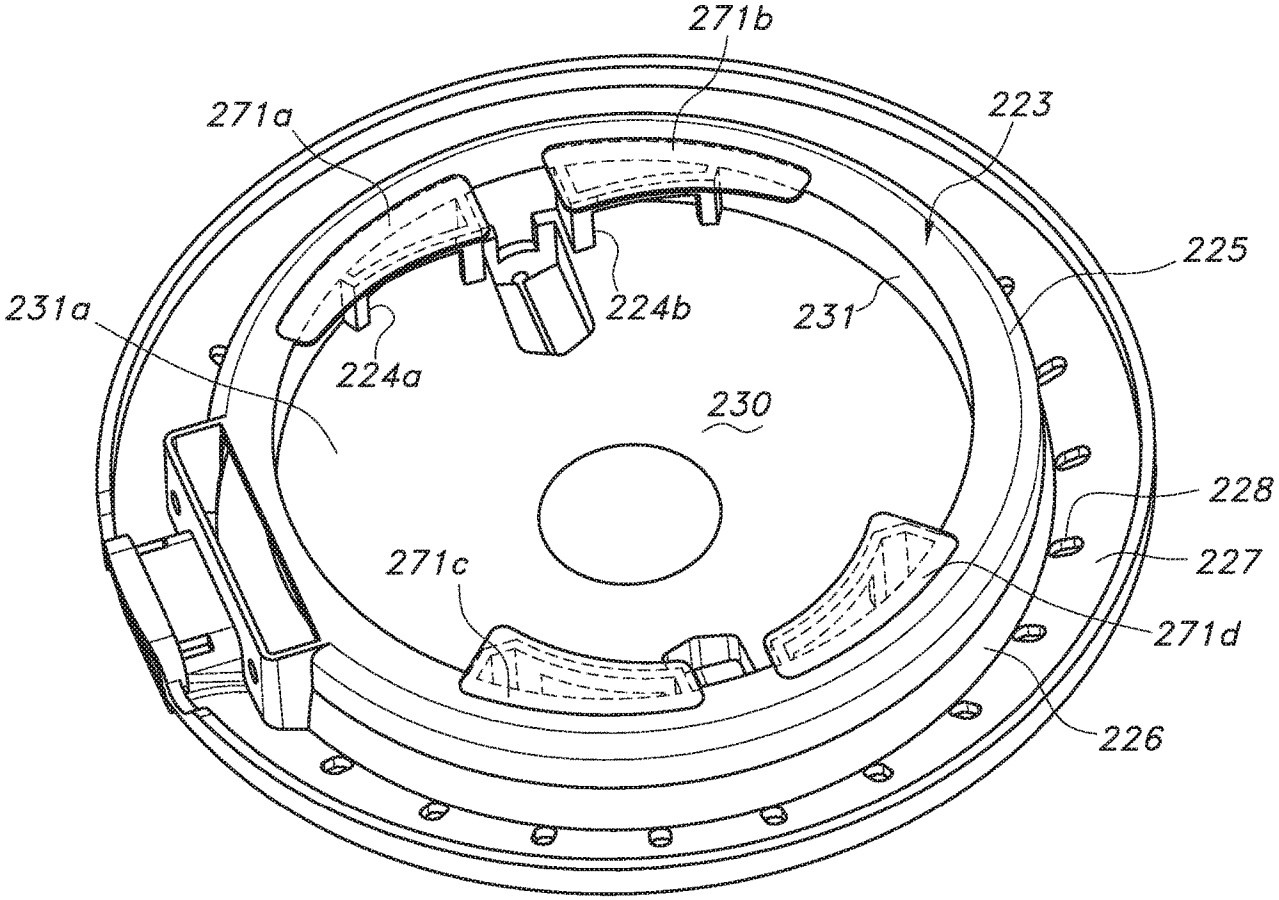
FIG. 7 shows the rear housing member shown in FIGS. 4 and 6 with acoustic mesh extending over several acoustic port exhaust apertures.
Figure 8:
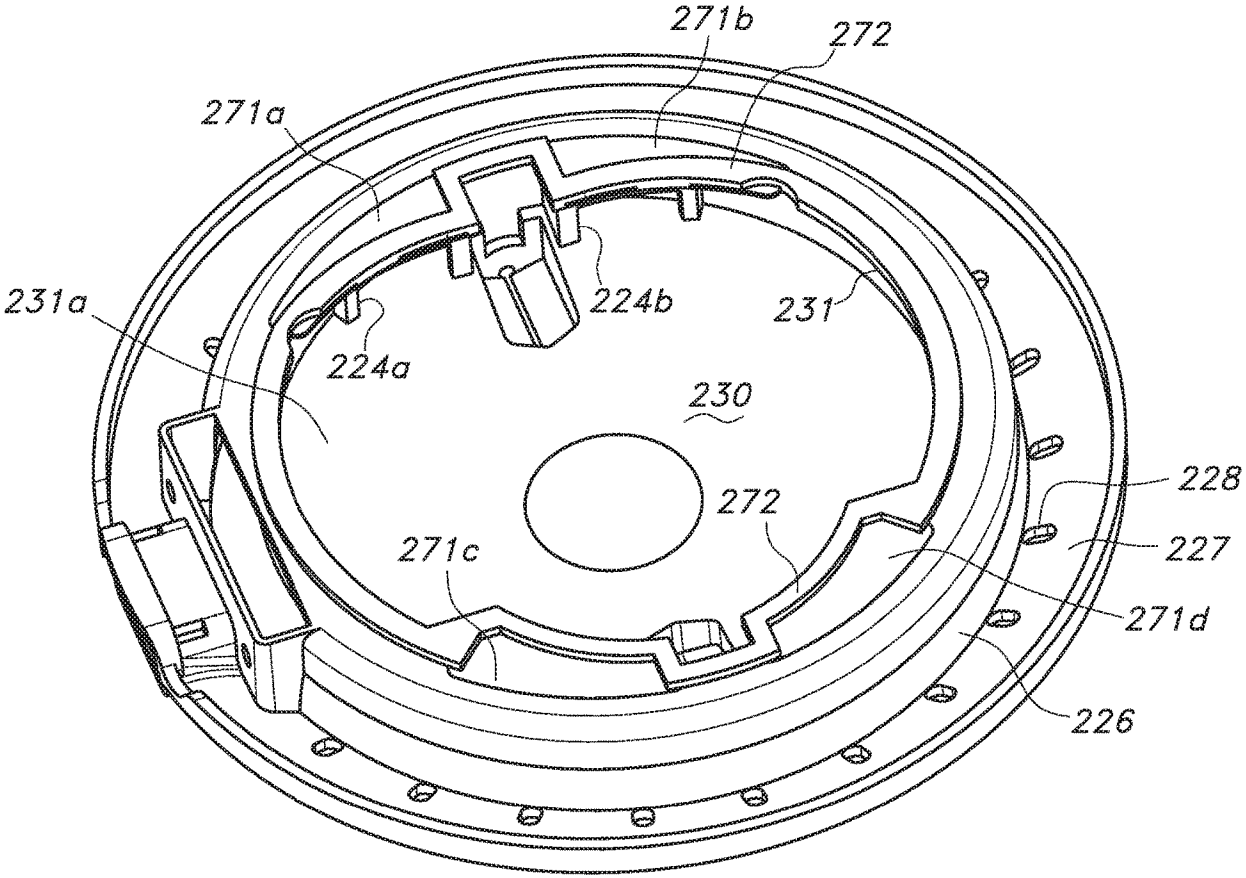
FIG. 8 shows the rear housing member shown in FIG. 7 with a gasket installed.

As shown in FIG. 7, the acoustic mesh or other acoustic damper 271*a-d* can overlie each exhaust aperture. The acoustic mesh can be affixed (e.g., by an adhesive) to the recessed shoulder 273*a-d*. In FIG. 8, a gasket 272 (also shown in FIG. 5), e.g., a closed-cell urethane foam, can extend circumferentially around the surface 225, and partially overlie the mesh 271*a-d*. The gasket shown in FIG. 7 leaves an acoustic passage between the rear chamber 230 and the outwardly extending waveguide 270. A suitable gaskets materials are well known. Some gaskets can be made from a urethane commercially available from the Rogers Corporation under the tradename PORON®. Other materials that can prevent airflow from bypassing the ports 224*a-d* (or port 124) can be used for the gasket.

Figure 9:
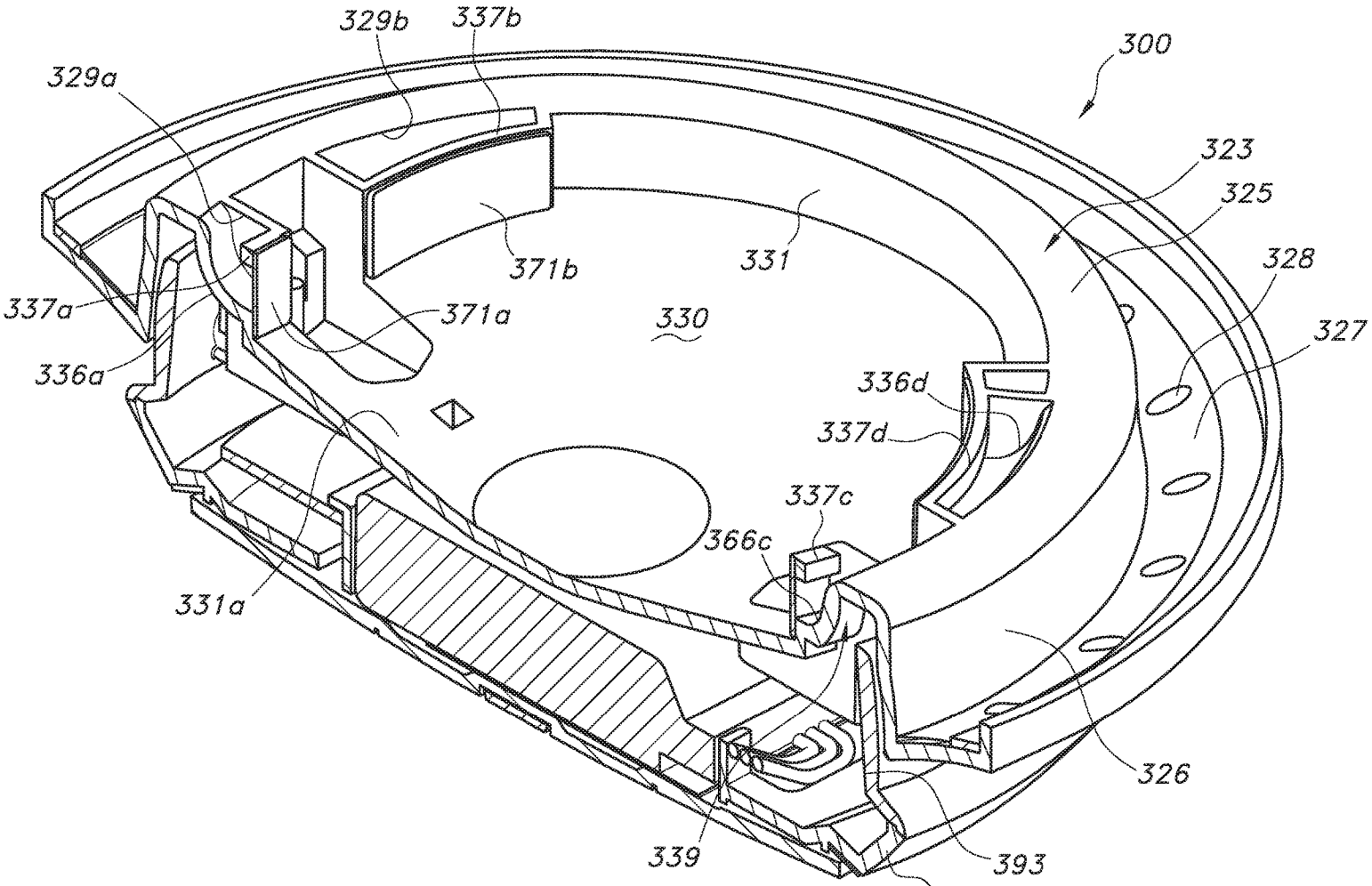
FIG. 9 shows a partial sectional view of the rear housing member shown in FIGS. 4 and 6 with acoustic mesh over several acoustic port inlet apertures.
Figure 10:
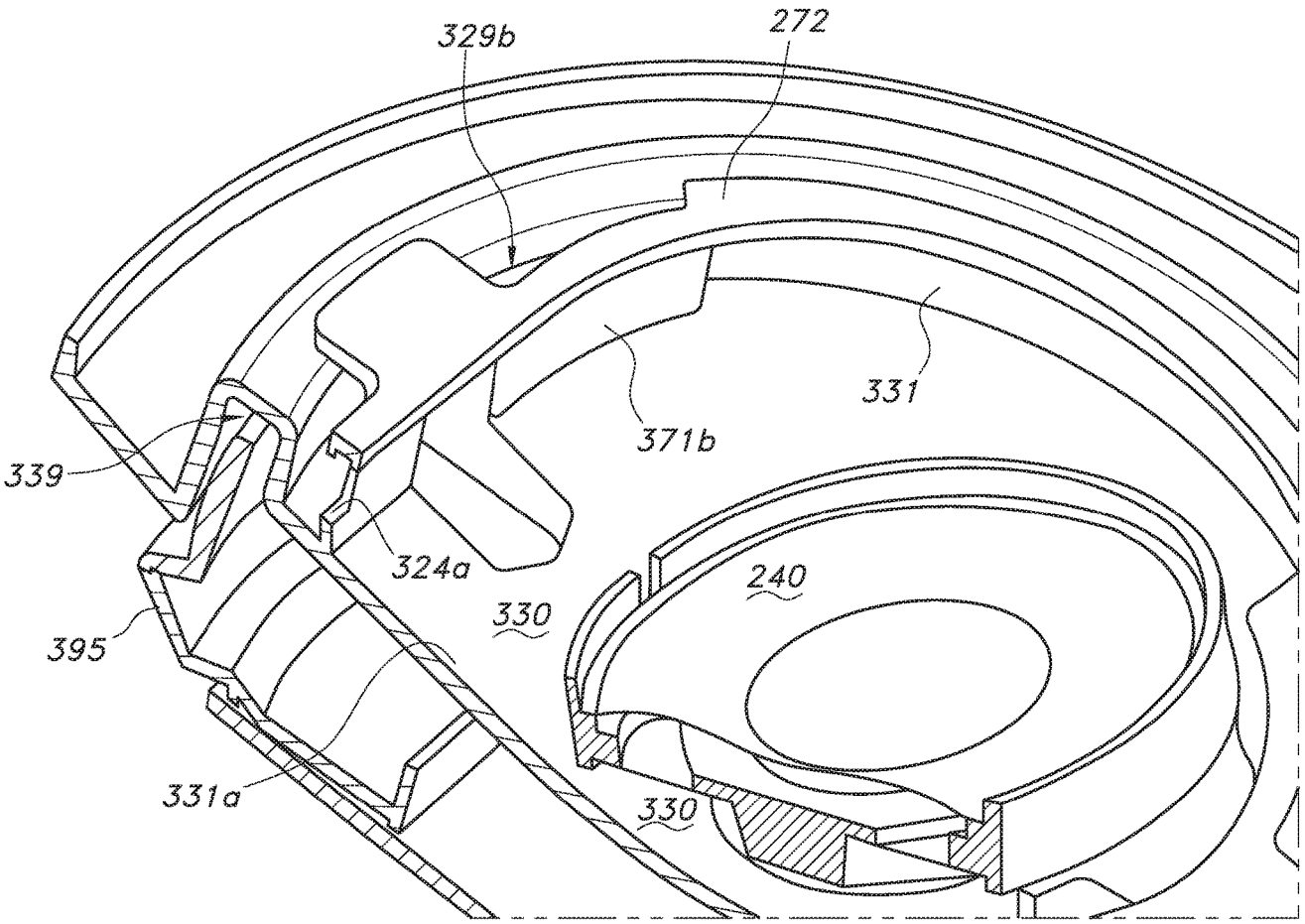
FIG. 10 shows a partial sectional view of the rear housing member and acoustic mesh arrangement shown in FIG. 9 with a gasket installed, as in FIG. 8.

In FIGS. 9 and 10, the mesh 371*a-d* is placed over the inlet to the port, rather than the exhaust 329*a-d*. The mesh can be affixed to the cross-member 337*a-d*, and the gasket 272 can be placed around the rear chamber, as shown in FIG. 10. In the example shown in FIG. 10, the wall 339 can have a curved contour 366*a-d* to ensure the cross-sectional area expands smoothly from the inlet aperture to the exhaust aperture 329*a-d* of the port 224*a-d*. Other features of the rear housing 300 having similar structure to the rear housing 210*a* have reference numerals incremented by 100.

In FIGS. 9 and 10, an outermost housing member 395 overlies the generally dome shaped member rear housing. The outermost housing member 395 defines a suitable enclosure for, for example, digital signal processing components, microphones, processors, and other headphone components. A circumferential wall 393 extends into the channel defined by the outer wall 326 and the inner wall 331.

Other Embodiments

The examples described above generally concern acoustic echo cancellation techniques and related systems. Incorporating one or more principles disclosed herein, it is possible to attenuate a wide-variety to noise spectra (e.g., spectra other than audible noise, such as electromagnetic interference, etc.).

Other embodiments than those described above in detail are contemplated based on the principles disclosed herein, together with any attendant changes in configurations of the respective apparatus described herein. For example, an acoustic port need not have any particular cross-sectional shape. In some instances, for example, an acoustic port can extend circumferentially around a boundary of a rear chamber. Similarly, the acoustic damper need not be discrete segments, as shown in the accompanying drawings, but rather can be distributed to a similar or lesser extent as the port(s) with which the damper is associated. For example, with a circumferentially extending, annular port, a corresponding acoustic damper can be a continuous annular damper having a unitary construction, or the damper can be formed of several juxtaposed annular sectors (e.g., arcuate segments) when assembled end-to-end form an annulus being coextensive with the circumferential port.

Directions and other relative references (e.g., up, down, top, bottom, left, right, rearward, forward, etc.) may be used to facilitate discussion of the drawings and principles herein, but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by references in its entirety for all purposes.

The principles described above in connection with any particular example can be combined with the principles described in connection with another example described herein. Accordingly, this detailed description shall not be construed in a limiting sense, and following a review of this disclosure, those of ordinary skill in the art will appreciate the wide variety of filtering and computational techniques can be devised using the various concepts described herein. Moreover, those of ordinary skill in the art will appreciate that the exemplary embodiments disclosed herein can be adapted to various configurations and/or uses without departing from the disclosed principles.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

Thus, in view of the many possible embodiments to which the disclosed principles can be applied, we reserve to the right to claim any and all combinations of features described herein, including, for example, the combinations of features recited in the following paragraphs and all that comes within the scope and spirit of the foregoing description.

What is currently claimed:

1. An enclosure for a speaker transducer, the enclosure comprising:

a rear housing member defining a concave chamber region having a longitudinal axis extending therethrough;

a front wall;

a rear wall longitudinally spaced apart from the front wall to define a channel positioned between the front wall and the rear wall and oriented transversely relative to the longitudinal axis, wherein the channel extends at least 90-degrees circumferentially around the longitudinal axis, and a port extending between the chamber region and the channel, wherein the port contracts from the chamber region such that a cross-sectional area of the port is substantially less than a cross-sectional area of the chamber region adjacent to the port, and the channel expands radially outward of the port such that the cross-sectional area of the port is less than a cross-sectional area of the channel adjacent to the port.

2. The enclosure according to claim 1, wherein the cross-sectional area of the channel outward of the port varies substantially linearly with radial position relative to the longitudinal axis.

3. The enclosure according to claim 2, wherein a gap-distance between the front wall and the rear wall is substantially constant radially outward of the port.

4. The enclosure according to claim 1, wherein the channel extends from a proximal end positioned adjacent the port to a terminal end positioned adjacent a vent between the channel and an environment.

5. The enclosure according to claim 4, wherein the cross-sectional area of the channel expands from a position radially outward of the port to a position adjacent the vent.

6. The enclosure according to claim 4, wherein the channel is arranged to attenuate acoustic noise entering the terminal end through the vent from the environment.

7. The enclosure according to claim 1, wherein the port and the channel are together configured as an acoustic low-pass filter having a cut-off frequency less than about 1,500 Hz.

8. The enclosure according to claim 1, wherein each of the rear waveguide member and the rear housing member constitutes a respective portion of a unitary construct.

9. The enclosure according to claim 8, wherein the rear housing member defines the port.

10. The enclosure according to claim 1, further comprising a front housing member, wherein each of the rear waveguide member and the front housing member constitutes a respective portion of a unitary construct.

11. The enclosure according to claim 10, wherein the front housing member defines the port.

12. The enclosure according to claim 1, further comprising an acoustic damper overlying the port.

13. The enclosure according to claim 12, wherein the acoustic damper comprises an acoustic mesh.

14. A headphone comprising:

a speaker transducer;

a front housing member and a rear housing member, wherein the speaker transducer is positioned between the front housing member and the rear housing member, and spaced apart from the rear housing member to define a rear chamber positioned between the speaker transducer and the rear housing member, wherein the rear housing member defines a longitudinal axis; and a first waveguide member and a second waveguide member spaced apart from each other to define an acoustic waveguide oriented transversely relative to the longitudinal axis;

a port acoustically coupling the acoustic waveguide with the rear chamber, wherein a cross-sectional area of the acoustic waveguide expands radially outward of the port relative to the longitudinal axis, wherein the acoustic waveguide extends circumferentially more than 90-degrees around the longitudinal axis, wherein a cross-sectional area of the port is substantially less than a cross-sectional area of the rear chamber at a position adjacent to the port and substantially less than the cross-sectional area of the acoustic waveguide at a position adjacent to the port, such that the port contracts from the rear chamber and expands to the acoustic waveguide.

15. The headphone according to claim 14, wherein the waveguide comprises an annular waveguide.

16. The headphone according to claim 14, wherein the speaker transducer defines a longitudinal axis, wherein the longitudinal axis of the speaker transducer is collinear with the longitudinal axis of the rear housing member.

17. The headphone according to claim 14, wherein the speaker transducer defines a longitudinal axis, wherein the longitudinal axis of the speaker transducer is offset from the longitudinal axis of the rear housing member.

18. The headphone according to claim 14, wherein each of the first waveguide member and the rear housing member constitutes a respective portion of a unitary construct.

19. The headphone according to claim 18, wherein the rear housing member defines the port.

20. The headphone according to claim 14, wherein each of the first waveguide member and the front housing member constitutes a respective portion of a unitary construct.

21. The headphone according to claim 20, wherein the front housing member defines the port.

22. The headphone according to claim 14, wherein the port comprises a first port, wherein the acoustic waveguide and the rear chamber are acoustically coupled together through at least one other port circumferentially spaced apart from the first port relative to the longitudinal axis defined by the rear housing member.

* * * * *